US009638414B2

(12) United States Patent
Johnson et al.

(10) Patent No.: US 9,638,414 B2
(45) Date of Patent: May 2, 2017

(54) SYSTEMS AND METHODS FOR PROCESSING MUNICIPAL WASTEWATER TREATMENT SEWAGE SLUDGE

(75) Inventors: Bruce Johnson, Indianhead Park, IL (US); Robert G. Graham, Presque, MI (US); Tony A. Kuipers, Grandville, MI (US); T. Terry Tousey, St. Louis, MO (US); Joseph C. Snodgrass, Crawfordsville, IN (US); David E. Prouty, Ada, MI (US)

(73) Assignee: Wastedry LLC, Chicago, IL (US)

( * ) Notice: Subject to any disclaimer, the term of this patent is extended or adjusted under 35 U.S.C. 154(b) by 1423 days.

(21) Appl. No.: 12/209,927

(22) Filed: Sep. 12, 2008
(Under 37 CFR 1.47)

(65) Prior Publication Data

US 2009/0249641 A1 Oct. 8, 2009

Related U.S. Application Data

(60) Provisional application No. 61/043,062, filed on Apr. 7, 2008.

(51) Int. Cl.

| | |
|---|---|
| ***F23G 5/027*** | (2006.01) |
| ***F23G 5/04*** | (2006.01) |
| ***F23G 5/16*** | (2006.01) |
| ***F23G 7/00*** | (2006.01) |
| ***F23J 15/08*** | (2006.01) |
| ***F26B 23/02*** | (2006.01) |

(52) U.S. Cl.

CPC ..... *F23G 5/027* (2013.01); *F23G 5/04* (2013.01); *F23G 5/16* (2013.01); *F23G 7/001* (2013.01); *F23J 15/08* (2013.01); *F26B 23/028* (2013.01); *F23B 2700/018* (2013.01); *F23B 2700/022* (2013.01); *F23G 2201/10* (2013.01); *F23G 2201/303* (2013.01); *F23G 2201/40* (2013.01); *F23J 2900/15081* (2013.01); *F26B 2200/18* (2013.01)

(58) Field of Classification Search

CPC ..... F23B 2700/018; F23B 2700/022
USPC ..... 110/210
See application file for complete search history.

(56) References Cited

U.S. PATENT DOCUMENTS

| | | | | |
|---|---|---|---|---|
| 3,954,069 | A * | 5/1976 | Loken | 110/221 |
| 4,054,424 | A * | 10/1977 | Staudinger et al. | 110/119 |
| 4,311,103 | A * | 1/1982 | Hirose | 110/238 |
| 4,466,361 | A * | 8/1984 | Henery et al. | 110/219 |
| 4,917,023 | A * | 4/1990 | Jones | 110/230 |
| 4,930,429 | A * | 6/1990 | Ryham | 110/229 |
| 5,171,552 | A | 12/1992 | Miura et al. | |
| 5,230,211 | A * | 7/1993 | McMahon et al. | 110/346 |
| 5,261,602 | A * | 11/1993 | Brent et al. | 110/347 |

(Continued)

OTHER PUBLICATIONS

Jones, Jerry, "Converting solid wastes and residues to fuel" Chemical Engineering, Jan. 2, 19 78, pp. 87-94 .

Jones, Jerr y, "Pyrolysis, Thermal Gasification, and Liquefaction of Solid Wastes and Residues" Worldwide Status of Processes (as of Fall 1977), pp. 387-396.

Klass, D onald L., "Energy From Biomass and Wastes" Institute of Gas Technology, Sep. 1978, pp. 1-27.

"Cha pter 11: High Temperature Processes" Process Design Manual for Sludge Treatment and Disposal, Sep. 1979.

(Continued)

*Primary Examiner* — David J Laux

(74) *Attorney, Agent, or Firm* — Reed Smith LLP

(57) ABSTRACT

The present invention relates generally to systems and methods for drying and gasifying substances using the calorific value contained in the substances, and it more specifically relates to apparatus and methods for processing wet, pasty, sticky substances, such as municipal wastewater treatment sewage sludge, into a workable, powdered product.

18 Claims, 2 Drawing Sheets

(56) References Cited

U.S. PATENT DOCUMENTS

| | | | | |
|---|---|---|---|---|
| 5,428,906 | A * | 7/1995 | Lynam et al. | 110/224 |
| 6,256,902 | B1 | 7/2001 | Flaherty et al. | |
| 6,410,283 | B1 | 6/2002 | Rehmat et al. | |
| 6,558,454 | B1 * | 5/2003 | Chang et al. | 110/342 |
| 7,241,322 | B2 | 7/2007 | Graham | |
| 7,294,314 | B2 | 11/2007 | Graham | |
| 7,762,317 | B2 | 7/2010 | Graham | |
| 7,976,593 | B2 | 7/2011 | Graham | |
| 2006/0196398 | A1 * | 9/2006 | Graham | 110/267 |
| 2007/0012232 | A1 * | 1/2007 | Skrypski-Mantele et al. | 110/238 |
| 2007/0251433 | A1 * | 11/2007 | Rabiner | 110/235 |
| 2008/0118310 | A1 | 5/2008 | Graham | |
| 2008/0209807 | A1 * | 9/2008 | Tsangaris et al. | 48/89 |
| 2009/0000301 | A1 | 1/2009 | Graham | |
| 2009/0020052 | A1 * | 1/2009 | Becchetti et al. | 110/346 |
| 2012/0200092 | A1 | 8/2012 | Johnson | |

OTHER PUBLICATIONS

A. van der Drift and H. Boerrigter, "Synthesis Gas from Biomass for fuels and chemicals" (2006).

Jared P. Ciferno and John J. Marano, "Benchmarking Biomass Gasification Technologies for Fuels, Chemicals and Hydrogen Production" (Jun. 2002).

James P. Bennett, "Refractory Liner Materials Used in Slagging Gasifiers," 9 (5): Refractories Applications and News 20-25 (2004).

U.S. Department of Energy, A Comparison of Gasification and Incineration of Hazerdous Wastes—Final Report (Mar. 30, 2000).

Testo, "Flue Gas in Industry" (2004).

"Gasification—The Waste-To-Energy Solution": Gasification Technologies Council, www.Gasification.org Copyright GTC 2011.

Fericelli, D. Paul "Comparison of Sludge Treatment by Gasification vs. Incineration" 9th Latin American and Caribbean Conference for Engineering and Technology, Dated: Aug. 3-5, 2011.

* cited by examiner

SYSTEMS AND METHODS FOR PROCESSING MUNICIPAL WASTEWATER TREATMENT SEWAGE SLUDGE

This application claims priority to U.S. Provisional Patent Application No. 61/043,062, filed on Apr. 7, 2008, which application is herein incorporated by reference in its entirety.

BACKGROUND OF THE INVENTION

1. Field of the Invention

The present invention relates generally to systems and methods for drying and gasifying substances using the calorific value contained in the substances and it more specifically relates to systems and methods for processing wet, pasty, sticky substances, such as municipal wastewater treatment sewage sludge, into a workable, powdered product.

2. Description of the Related Art

The primary problem facing every municipal wastewater treatment facility is the cost-effective, energy-efficient and environmentally-sound disposal of sewage sludge, the end product of wastewater processing. North America produces about 0.21 pounds of sewage sludge (on a dry basis) daily for every man, woman and child. In the United States, there are approximately 16,000 municipal wastewater treatment plants, with more being build each year to accommodate the growing population base. The EPA estimates that these plants generate about 7-8 million dry tons of sewage sludge per year. Typically, the sludge is mechanically dried at the municipal wastewater treatment plant to a wet cake consisting of approximately 25% solids and 75% moisture before it is processed further or sent off-site for disposal or beneficial re-use. Thus the total volume of wet sewage sludge cake managed each year by municipal wastewater treatment plants amounts to about 28-32 million wet tons. Annual costs for processing this waste are in excess of five billion dollars.

Historically, municipal sewage sludge management disposal programs relied upon: land filling; surface disposal; incineration; ocean dumping (banned in the United States in 1992); and/or beneficial reuse through land application. Each of these methods may be relatively inexpensive, but each may have undesirable aspects which result in a negative long-term cost to the environment.

A major portion of the United States' sewage sludge has been sent to landfills. As a result, valuable landfill space for large communities has been either so reduced, or the odor and quality of the sewage sludge cake make it so undesirable, that a great proportion of the nation's sewage sludge is now hauled a considerable distance to its final disposition. For example, over 75% of New York City's sludge is sent out of state to places as far away as Colorado and Texas. Portland, Oreg. trucks approximately 75,000 tons per year over 200 miles to Hermiston, Oreg. to be land-applied for beneficial reuse.

Another substantial portion of the sewage sludge in the United States has been sent to surface disposal sites. Surface disposal sites include monofills; surface impoundments and lagoons; waste piles; dedicated disposal sites; and dedicated beneficial use sites. Surface disposal differs from land application in that the sewage sludge that is surface disposed is placed on the surface of the land, rather than applied to enrich nutrient-depleted or barren soil.

However, a large number of states now have site restrictions or management practices governing sewage sludge disposal. Federally, the Clean Air Act, which governs sewage sludge incineration and the disposal of its residual ash, has recently been amended (the "Clean Air Act Amendments") to levy stricter air emission measures for incineration. Further, in 1993 the EPA published 40 CFR part 503 Sludge Regulations (503 Regulations) employing the EPA's "exceptional quality" sewage sludge program. The 503 Regulations established "Standards for the Use or Disposal of Sewage Sludge" applicable to all wastewater treatment facilities. The 503 Regulations establish requirements for the final use or disposal of sewage sludge when sewage sludge is: applied to land to condition the soil or fertilize crops or other vegetation grown in the soil; placed on a surface disposal site for final disposal; or fired in a sewage sludge incinerator. The 503 Regulations also direct that if sewage sludge is placed in a municipal solid waste landfill, the provisions of 40 CFR Part 258 must be met. These provisions cover, in great detail, all aspects of establishing, maintaining and monitoring such landfills. Almost all communities are pursuing alternatives to incineration and landfilling.

"Land application for beneficial use" is the application of sewage sludge to land, either to condition the soil, or to fertilize crops or other vegetation grown in the soil. Sewage sludge may be beneficially land-applied on agricultural land, forest land, reclamation sites, golf courses, public parks, roadsides, plant nurseries and home land and gardens. Under the 503 Regulations, sewage sludge products that meet stringent requirements, including sufficiently low concentrations of certain pathogens and pollutants, and minimal attractiveness to disease vectors such as insects and rodents, are considered by the EPA to be Class A, "Exceptional Quality" sewage sludge. Class A sewage sludge is treated by the EPA in the same manner as common fertilizers; thus, this material is exempt from federal restrictions on their agricultural use or land application. Sewage sludge falling short of the highest EPA standards may nevertheless qualify as Class B sewage sludge.

Sewage sludge that meet Class B requirements may also be applied to the land for beneficial use, but is subject to greater record keeping, reporting requirements and restrictions governing, including among other items, the type and location of application, and the volume of application. Sewage sludge applied to the land for agricultural use must meet Class B pathogen levels and, if applied in bulk, require an EPA permit. Although land-application for beneficial reuse has heretofore been the best alternative, even this has drawbacks, including substantial fuel and personnel costs, odor complaints from neighbors and wear-and-tear on roads. In addition, you cannot land apply sludge during the winter months in cold weather climates.

Under the 503 Regulations, sewage sludge disposed of by surface disposal is subject to increased regulation by requiring, among other things: restricted public access; run-off and leachate collection systems; methane monitoring systems; and monitoring of, and limits on, pollutant levels. Surface disposal differs from land application in that, sewage sludge placed in a surface disposal site is required to meet, at least, Class B requirements.

Over the past few years, there has been a movement toward surface disposal of wet sewage sludge. However, in large metropolitan areas and rural communities alike, proposals to land-apply wet sewage sludge have been met with great resistance from the public. Factors affecting the acceptance of land-application are local geography, climate, odors, contaminants, land use, transportation costs and regulatory constraints.

Thus, the current 503 Regulations-compliant alternatives in municipal sewage sludge disposal are: to destroy it through incineration; to land-apply it under heavy public scrutiny and an overbearing regulatory scheme; to convert it to a more desirable form through composting; or, to reduce the volume of sewage sludge using drying methods that have heretofore been exceedingly costly. Overall, drying would be most desirable, were it not for the cost in fuel and expensive equipment.

The challenge in drying a pasty, sticky, gelatinous and difficult-to-handle material like sewage sludge is in removing the moisture trapped inside. Typically, wet sewage sludge is processed to a 20-25% solid cake through mechanical dewatering methods such as using centrifuges and belt filter presses. In order to remove more of the moisture, you need to apply energy—generally in the form of heat—to the sludge.

The current state of thermal-drying technology in the wastewater treatment industry is dominated by two heat drying technologies: direct and indirect. Direct drying technology puts hot air in direct contact with the sewage sludge during the drying process. Indirect drying technology causes the sewage sludge to come into direct contact with a heated surface, as opposed to hot air. U.S. Pat. No. 6,256,902 describes a system for drying wastewater sewage sludge, and is incorporated in its entirety by reference.

A myriad of new treatment technologies for removing the moisture from sewage sludge are being developed for small-scale operation. Some of these employ ultrasonic, microwave, additional adapted plate and frame technology, and radiant heat processes. However, none of these new technologies, nor those described elsewhere, meet the high-volume sewage sludge-processing needs of the major wastewater treatment facilities throughout the world. Indeed, virtually every wastewater treatment facility is looking for an economical, energy-efficient and environmentally-sound technology which dries municipal sewage sludge and recycles its end product.

SUMMARY OF THE INVENTION

Methods and systems consistent with the present invention provide improved methods of handling sewage sludge, such as municipal wastewater treatment sewage sludge, that are more cost-efficient, and which result in fewer and less noxious by-products. These methods utilize the principles of recycling and energy recovery, thereby reducing the costs of treating the sewage sludge and of handling the levels and amounts of by-products of the process.

In accordance with methods consistent with the present invention, a method is provided for processing a sewage sludge composition. The method comprises the steps of drying the sewage sludge composition into a partially dried compound; converting a portion of the partially dried compound into a gaseous fuel; combusting the gaseous fuel to produce a hot flue gas; using the hot flue gas to heat air; and using the heated air, directly or indirectly, to dry the sewage sludge composition.

In accordance with methods consistent with the present invention, a method is provided for processing a sewage sludge composition. The method comprises the steps of drying the sewage sludge composition into a partially dried compound; converting a portion of the partially dried compound into a gas; combusting the gas to produce heat; and using the heat to dry the sewage sludge composition.

In accordance with articles of manufacture consistent with the present invention, a system is provided for processing sewage sludge. The system comprises a dryer for partially drying the sewage sludge; a gasifier for converting the partially dried sewage sludge into a gaseous fuel; and an oxidizer for combusting the gaseous fuel to produce heat, wherein the heat is used directly or indirectly to partially dry the sewage sludge in the dryer.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims. Accordingly, the present invention is not to be restricted except in light of the attached claims and their equivalents.

BRIEF DESCRIPTION OF THE FIGURES

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Methods and systems consistent with the present invention allow for the processing of sewage sludge compositions in a manner that is efficient and generates very little in the way of solid waste or air pollutants. In addition to drying the sewage sludge, these systems and methods also recovery the energy value from and beneficially reuse the products that normally result from the drying of such materials.

Figure 1:
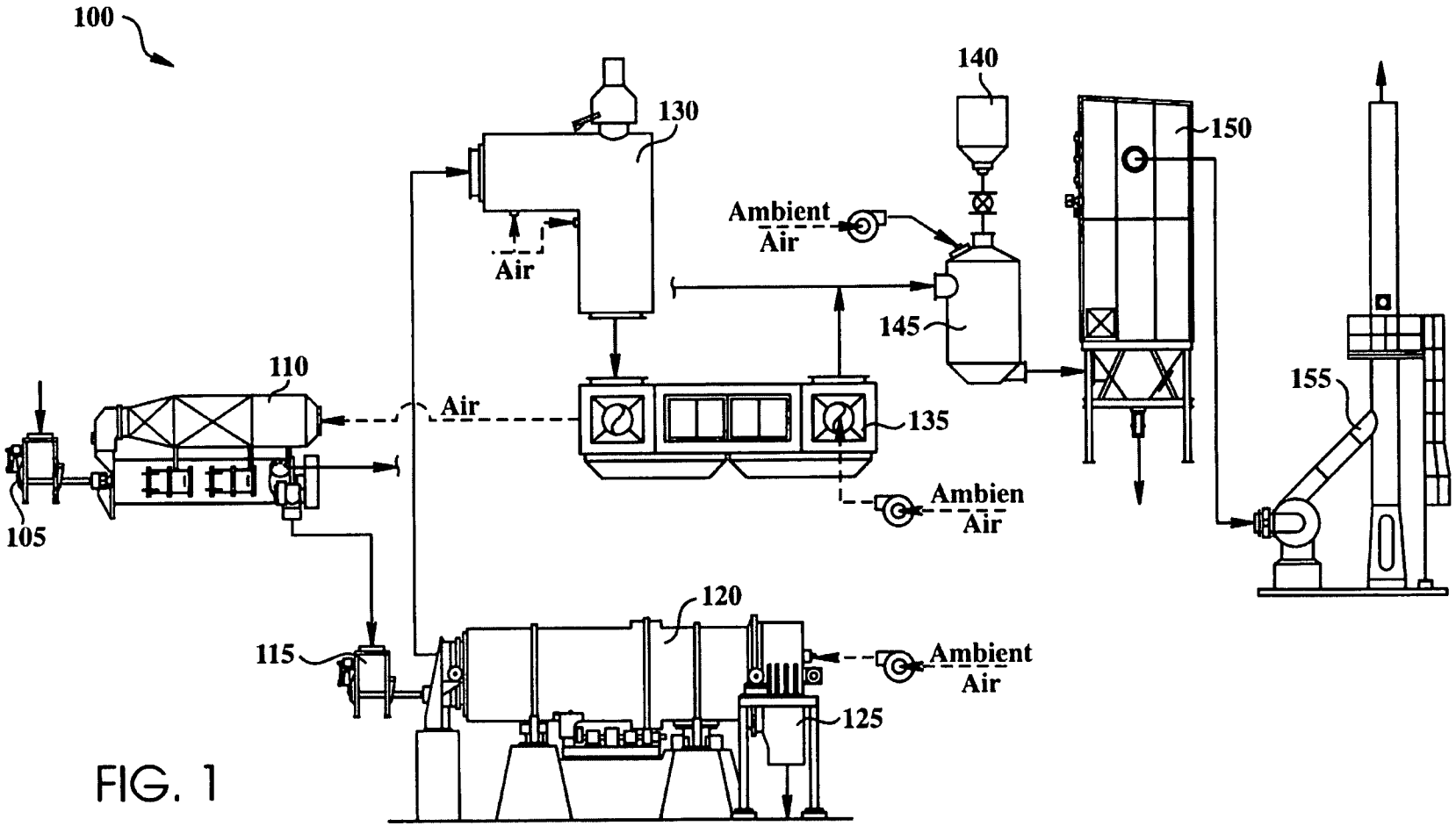
FIG. 1 depicts an overview of a preferred embodiment of a system for drying and gasification of sewage sludge in accordance with the present invention. Dotted lines indicate air flow, either as ambient air or air flow into or between system components.

FIG. 1 depicts a system 100 suitable for practicing the methods consistent with the present invention. The system includes a first material feeder 105, a dryer 110, a second material feeder 115, a gasifier 120, an ash removal system 125 and storage tank (not shown), a low NOx oxidizer 130, an air to air heat exchanger 135, a lime injection system 140, a pathogen destruction furnace 145, an air pollution control device 150, and a stack for exhausting the treated, clean gas 155. The distances between the pieces of equipment depend upon the available space.

Figure 2:
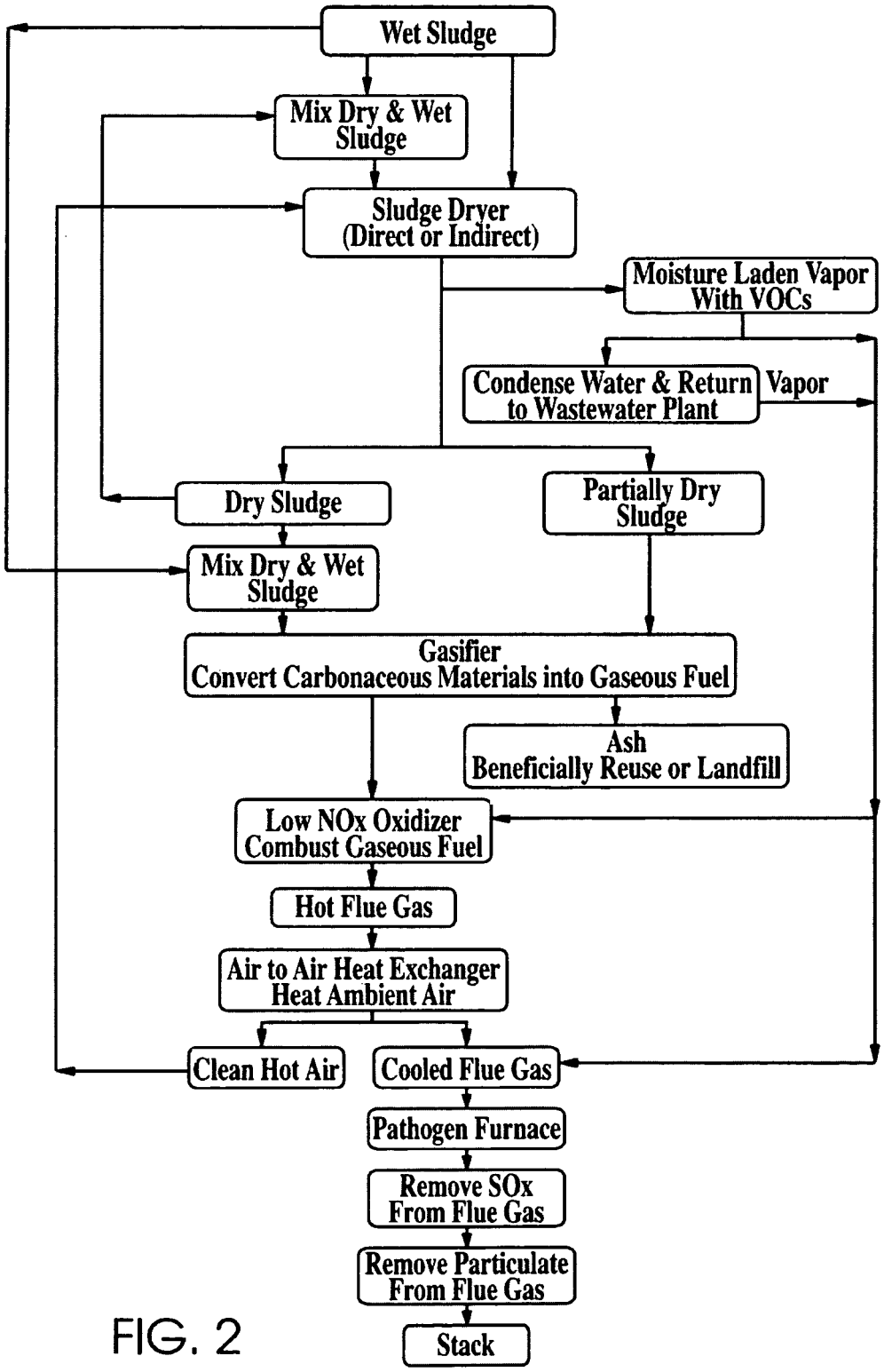
FIG. 2 depicts a flow diagram of the steps performed by the system in FIG. 1.

FIG. 2 depicts a flow diagram illustrating one embodiment of the method used to process the sewage sludge in accordance with methods and systems consistent with the present invention. The first material feeder 105 conveys wet sewage sludge into the dryer 110. One skilled in the art will recognize that each material feeder 105, 115 may be of any type that is capable of moving wet or dry materials between two pieces of equipment, e.g., a belt or screw conveyor, or any other type of conveyor known in the art. The sewage sludge also may be pumped, depending on the level of wetness of the material. The sewage sludge may be loaded into a live bottom hopper where it may be conveyed at a controlled rate to the feed hopper of the dryer. The conveyor distance is preferably about 25 feet or more. The feed hopper may feed the material into the dryer 110 at a controlled rate through a rotary air lock device.

Dryer 110 partially dries the sewage sludge to reduce the moisture content of the sewage sludge from approximately 65-80% to approximately 30-50%. Depending on the characteristics of the sludge it may be dried to less than 10% moisture. The dryer 110 may be a rotary dryer, belt dryer, ring dryer, thermal screw auger, filter press or any other dryer known in the art. The transit time in the dryer 110 may be from seconds in a ring-type dryer to about three to about six hours using a thermal screw auger. Rotary dryers 110 may process sewage sludge materials in a time frame between a ring dryer and a thermal screw auger dryer. The type of dryer 110 selected may relate to the volume of material to be processed, the physical characteristics of the material to be processed, and the rate at which the material is to be processed. The device may utilize direct heat where the drying air is in direct contact with the sewage sludge, or indirect heat where hot air, steam, oil or electricity is used to indirectly dry the material and does not come in direct contact with the sewage sludge. Moreover, depending on the dryer system, a portion of the partially dried sewage sludge exiting the dryer 110 may be conveyed back to the front of the dryer and mixed with the wet material to reduce the total moisture content of the material going into the dryer 110. Depending on the length and type of dryer, the length of the conveyor back to the front of the dryer may be approximately 40 to 50 feet. If this backmixing is performed, a mixing hopper may be required to mix the dry and wet materials together prior to conveying it to the feed hopper of the dryer 110.

Preferably, the material in the dryer 110 is heated to about 210° F. to about 223° F., which is hot enough to boil off the water. The heating medium (hot air, hot oil or steam) used to raise the temperature of the sewage sludge in the dryer 110 is somewhat higher. For example, the temperature may be about 350° F. for steam, about 950° F. for hot air, and about 300° F. for hot oil.

Material feeder 115 conveys the partially dried sewage sludge to the gasifier 120. The partially dried sewage sludge may go into a feed hopper and be fed to the gasifier 120 through a rotary air lock device. The conveyor portion of the material feeder 115 will preferably be less than about 20 feet. The gasifier 120 should receive about 60% dry material (about 40% moisture). However, the sewage sludge may become very sticky at this level of dryness. If the stickiness of the sewage sludge is too great, the material may be dried to about 90% dryness in the dryer 110, and mixed with wet material prior to feeding it to the gasifier 120 to obtain the optimal moisture content. If this mixing is required, a mixing hopper may be required to mix the dry and wet materials together and the wet material may be conveyed about 60 feet or more from the sewage sludge storage to the mixing hopper prior to the delivery to the gasifier 120. One skilled in the art will recognize that various types of gasifiers may be used, including a rotary, retort cell, fixed-bed or fluidized-bed type gasifier.

Gasifier 120 converts the carbonaceous materials in the partially dried sewage sludge into a gaseous fuel by applying heat, typically between about 600° F. and about 1,000° F., in an oxygen-starved environment. The gaseous fuel, called syngas, is primarily hydrogen and carbon monoxide with lesser amounts of other gaseous constituents. The amount of air or oxygen available inside the gasifier 120 is carefully controlled so that only a relatively small portion of the fuel burns completely. This provides the heat for subsequent reactions. Rather than burning, most of the carbon-containing materials in the sewage sludge are chemically broken apart by the heat inside the gasifier 120, setting into motion the chemical reactions that produce the syngas. Due to the heat generated from the gasification process, the gasifier 120 also does some drying of the sewage sludge prior to producing the syngas.

The solid minerals in the sewage sludge (i.e., the rocks, dirt and other impurities which don't gasify) separate and leave the bottom of the gasifier 120 as an inert ash that can be safely handled in a number of ways, including beneficial reuse of the ash as a marketable solid product. Only a small fraction of the mineral matter is carried out of the gasifier as fly ash and may require removal downstream in the air pollution control device. The ash generated by the gasifier 120 may be cooled and conveyed via the ash removal system 125 to an ash storage tank prior to being transported off-site. The length of the conveyor necessary to move the ash may be about 20 feet to about 30 feet. The conveyor may feed a bucket elevator that takes the material to the top of the storage tank to feed it into the tank.

The syngas produced by the gasifier 120 may be sent to a low NOx oxidizer 130. Here, air is injected in stages, into the low NOx oxidizer 130 to combust the syngas to produce hot flue gas. This combustion is a staged process that is specifically designed to reduce the amount of NOx (i.e., compounds containing nitrogen and oxygen such as NO, $NO_2$ and $N_2O$) produced in the flue gas from the combustion of the syngas. The low NOx oxidizer 130 may run at about 1800° F. The low NOx oxidizer 130 may be situated directly above, along side or after the gasifier 120 at the end where the resulting syngas exits.

The hot flue gases generated from the combustion of the syngas in the oxidizer are sent through an air-to-air heat exchanger 135 where the temperature of the flue gases is reduced to a level that protects the downstream air pollution control equipment, and clean air is heated to the appropriate temperature required by the dryer 110. The heated clean air from the heat exchanger 135 may be used directly or indirectly to dry additional sewage sludge in the dryer 110 in lieu of firing the dryer with auxiliary, non-renewable fuel. Accordingly, the syngas produced from the gasification of the partially dried sewage sludge ultimately is used to provide the energy needed to dry the wet sewage sludge in the dryer 110. Thus, the system of the invention is able to capture the energy in the sludge and use it in process to perpetuate the process itself. Depending on the plant layout, the duct bringing the heated, clean air from the air-to-air heat exchanger 135 to the dryer 110 may be approximately 20 to 50 feet.

In the drying of sewage sludge compositions a certain amount of volatile organic compounds ("VOCs") and/or residual pathogens may be released into the moisture-laden gas stream coming off the dryer 110 during the drying process of the sewage sludge. In order to meet air pollution control regulations, the moisture-laden gas stream off the dryer also may be mixed with the hot flue gas after it exits the heat exchanger 135 and ducted directly to the pathogen destruction furnace 145, to destroy any residual pathogens and/or VOCs coming off the dryer 110. This ducting may be about 30 feet to about 50 feet in length. The pathogen destruction furnace 145 may be of any known type capable of reducing the amount of residual pathogens and/or VOCs to a level within the regulatory limits of the facility's air permits.

The pathogen destruction furnace 145 may also function as a gas scrubbing device to remove any acid gases produced from the process. A lime injection system 140 introduces lime into the cooled flue gases in the pathogen destruction furnace 145 to reduce the amount of SOx (i.e., compounds that contain sulfur and oxygen, and generally relate to $SO_2$ and $SO_3$ emissions) and any other acid gases that are generated during combustion. Most municipal sewage sludge materials contain sulfur compounds which generate SOx when combusted. The lime injection system 140 may be placed above or next to the pathogen destruction furnace 145, and it may feed lime through a rotary air lock to the pathogen destruction furnace 145 to scrub the gases.

After treatment in the pathogen destruction furnace 145, the scrubbed gases may be moved through an air pollution control device 150, which controls the amount of particulate emissions. The ducting between the pathogen destruction furnace 145 and the air pollution control device 150 may be about 15 feet in length. After treatment in the air pollution control device 150, the gases are routed to the stack via ducting that may be about 25 feet in length, and exit the system through the stack 155.

Other embodiments of the invention relate to the calorific value of the sewage sludge compositions. If the energy contained in the sewage sludge is greater than what was needed for drying, the excess energy in the hot flue gas off the low NOx oxidizer may be used to create electricity. This is done by using the excess clean hot air off the heat exchanger 135 in a waste heat boiler to make steam to drive a turbine or using the excess clean hot air off the heat exchanger 135 directly to drive a turbine. In addition, the syngas generated off the gasifier 120 may be cleaned and burned directly in an internal combustion engine to create electricity or used to fire the dryer 110.

The hot flue gas generated from the combustion of the syngas in the low NOx oxidizer 130 may also be used directly to dry the sewage sludge in the dryer 110. After the hot flue gas is sent through the heat exchanger 135 to reduce the temperature of the flue gas the flue gas may be used directly to dry the sewage sludge in the dryer 110 in lieu of using the heated clean air from the heat exchange 135. This method would reduce the oxygen content in the gas stream in the dryer to a level that would not support combustion.

Water and volatile organic compounds also may be condensed out of the vapor stream and discharged back to a municipality's waste water treatment plant. A condenser may be included to condense the moisture and volatile organic compounds from the gas stream off the dryer 110 and the condensed liquid may be fed back to the waste water treatment plant. Any non-condensable gases may be fed to the gasifier 120 or the low NOx oxidizer 130. This process would conserve energy because the pathogen destruction furnace 145 would not be needed to burn off any VOCs that may come off the dryer 110.

While various embodiments of the present invention have been described above, it should be understood that such disclosures have been presented by way of example only, and are not limiting. Thus, the breadth and scope of the present invention should not be limited by any of the above-described exemplary embodiments, but should be defined only in accordance with the following claims and their equivalents.

Having now fully described the invention, it will be understood by those of ordinary skill in the art that the same may be performed within a wide and equivalent range of conditions, formulations and other parameters without affecting the scope of the invention or any embodiment thereof. All patents, patent applications and publications cited herein are fully incorporated by reference in their entirety.

We claim:

1. A system for processing a sewage sludge, comprising:

a dryer for partially drying the sewage sludge;

a gasifier for substantially converting the partially dried sewage sludge into syngas, wherein the gasifier applies heat in an oxygen-starved environment, whereby carbon-containing materials in partially dried sewage sludge chemically react to produce the syngas without burning;

a low NOx oxidizer for combusting substantially all of the syngas to substantially reduce NOx compounds and produce heat and hot flue gas, wherein the heat is used to directly or indirectly partially dry the sewage sludge in the dryer;

a pathogen destruction furnace downstream from the low NOx oxidizer for substantially destroying volatile organic compounds and/or residual pathogens; and a lime injection system for substantially removing SOx in the pathogen destruction furnace.

2. The system of claim 1, comprising an air injection system to inject air into the low NOx oxidizer in stages to combust the syngas and produce heat.

3. A method for processing a sewage sludge composition comprising:

drying a sewage sludge composition into a partially dried compound;

using a gasifier to apply heat in an oxygen-starved environment to substantially convert a portion of the partially dried compound into syngas, wherein carbon-containing materials in the partially dried compound chemically react to produce the syngas without burning;

combusting substantially all of the syngas in a low NOx oxidizer to substantially reduce NOx compounds and produce heat and hot flue gas;

directing the hot flue gas to a pathogen destruction furnace;

substantially destroying pathogens and volatile organic compounds in the flue gas in the pathogen destruction furnace;

substantially removing SOx from the flue gas in the pathogen destruction furnace by injecting lime into the pathogen destruction furnace; and using the heat to dry the sewage sludge composition.

4. The method of claim 3, wherein the heat is used to directly dry the sewage sludge composition.

5. The method of claim 3, wherein the heat is used to indirectly dry the sewage sludge composition.

6. The method of claim 3, wherein drying the sewage sludge composition includes releasing a moisture-laden gas stream, and wherein the method further comprises condensing moisture out of the gas stream to produce a condensed liquid, and feeding the condensed liquid to a waste water treatment plant.

7. The method of claim 3, wherein drying the sewage sludge composition includes releasing a moisture-laden gas stream, and wherein the method further comprises condensing volatile organic compounds out of the gas stream to produce a condensed liquid, and feeding the condensed liquid to a waste water treatment plant.

8. The method of claim 7, further comprising destroying volatile organic compounds in the moisture-laden gas stream.

9. The method of claim 3, wherein air is injected into the low NOx oxidizer in stages to combust the syngas and produce heat.

10. A method for processing a sewage sludge composition comprising:

drying a sewage sludge composition into a partially dried compound;

using a gasifier to apply heat in an oxygen-starved environment to substantially convert a portion of the partially dried compound into syngas, wherein carbon-containing materials in the partially dried compound chemically react to produce the syngas without burning;

combusting substantially all of the syngas in a low NOx oxidizer to substantially reduce NOx compounds and produce a hot flue gas;

directing the hot flue gas to a pathogen destruction furnace;

substantially destroying pathogens and volatile organic compounds in the flue gas in the pathogen destruction furnace;

substantially removing SOx from the flue gas in the pathogen destruction furnace by injecting lime into the pathogen destruction furnace;

using the hot flue gas to heat air; and using the heated air to dry the sewage sludge composition.

11. The method of claim 10, wherein the heated air is used to directly dry the sewage sludge composition.

12. The method of claim 10, wherein the heated air is used to indirectly dry the sewage sludge composition.

13. The method of claim 10, further comprising reducing the particulate emission in the flue gas.

14. The method of claim 10, wherein drying the sewage sludge composition includes releasing a moisture-laden gas stream, and wherein the method further comprises condensing moisture out of the gas stream to produce a condensed liquid, and feeding the condensed liquid to a waste water treatment plant.

15. The method of claim 14, further comprising destroying volatile organic compounds in the moisture-laden gas stream.

16. The method of claim 10, wherein drying the sewage sludge composition includes releasing a moisture-laden gas stream, and wherein the method further comprises condensing volatile organic compounds out of the gas stream to produce a condensed liquid, and feeding the condensed liquid to a waste water treatment plant.

17. The method of claim 16, further comprising destroying volatile organic compounds in the moisture-laden gas stream.

18. The method of claim 10, wherein air is injected into the low NOx oxidizer in stages to combust the syngas and produce heat.

* * * * *